US006883359B1

(12) United States Patent
Hartwig, Jr.

(10) Patent No.: US 6,883,359 B1
(45) Date of Patent: Apr. 26, 2005

(54) EQUAL CHANNEL ANGULAR EXTRUSION METHOD

(75) Inventor: Karl T. Hartwig, Jr., College Station, TX (US)

(73) Assignee: The Texas A&M University System, College Station, TX (US)

( * ) Notice: Subject to any disclaimer, the term of this patent is extended or adjusted under 35 U.S.C. 154(b) by 0 days.

(21) Appl. No.: 10/326,547

(22) Filed: Dec. 20, 2002

Related U.S. Application Data

(60) Provisional application No. 60/343,522, filed on Dec. 20, 2001.

(51) Int. Cl.[7] ..... B21C 23/00

(52) U.S. Cl. ..... 72/253.1; 72/272; 72/364

(58) Field of Search ..... 72/253.1, 272, 72/273, 364

(56) References Cited

U.S. PATENT DOCUMENTS

| | | | | |
|---|---|---|---|---|
| 5,513,512 | A * | 5/1996 | Segal | 72/253.1 |
| 5,600,989 | A * | 2/1997 | Segal et al. | 72/253.1 |
| 5,809,393 | A * | 9/1998 | Dunlop et al. | 419/61 |
| 5,826,456 | A * | 10/1998 | Kawazoe et al. | 72/253.1 |
| 5,904,062 | A * | 5/1999 | Semiatin et al. | 72/253.1 |
| 6,723,187 | B1 * | 4/2004 | Segal et al. | 148/538 |

* cited by examiner

*Primary Examiner*—Ed Tolan
(74) *Attorney, Agent, or Firm*—Baker Botts L.L.P.

(57) ABSTRACT

According to one embodiment of the present invention, an equal channel angular extrusion (ECAE) method includes extruding a billet of material along a first axis in a first orientation through an ECAE die, extruding the billet along the first axis in a second orientation through the ECAE die, the second orientation oriented approximately 180° from the first direction, extruding the billet along the first axis in a third orientation through the ECAE die, the third orientation oriented approximately 90° from the second orientation, and extruding the billet along the first axis in a fourth orientation through the ECAE die, the fourth orientation oriented approximately 180° from the third orientation.

20 Claims, 5 Drawing Sheets

QUALITATIVE COMPARISON OF RECRYSTALLIZED MICROSTRUCTURES RESULTING FROM DIFFERENT ECAE PROCESSING ROUTES

| MATERIAL | UNIFORMITY OF RECRYSTALLIZED MICROSTRUCTURE | LEVEL OF TEXTURE AS-WORKED |
|---|---|---|
| INITIAL CONDITION | NON-UNIFORM | ZERO(UNWORKED) |
| | | |
| ONE ECAE PASS | | |
| ROUTE A | NON-UNIFORM | MEDIUM |
| | | |
| TWO ECAE PASSES | | |
| ROUTE A | NON-UNIFORM | MEDIUM |
| ROUTE B | NON-UNIFORM | MEDIUM |
| ROUTE C | NON-UNIFORM | LOW |
| | | |
| FOUR ECAE PASSES | | |
| ROUTE A | NON-UNIFORM | MEDIUM |
| ROUTE B | NON-UNIFORM | MEDIUM |
| ROUTE C | UNIFORM | LOW |
| ROUTE D | UNIFORM | LOW |
| ROUTE E | UNIFORM | LOW |
| ROUTE F | UNIFORM | LOW |

600

602

604

*FIG. 4*

400

MATERIAL YIELD FOR DIFFERENT ROUTES OF MULTIPASS ECAE PROCESSING(1)

| | NUMBER OF PASSES | | | | |
|---|---|---|---|---|---|
| ROUTE | 1 | 2 | 3 | 4 | 8 |
| A | 83.3 | 75.0 | 66.7 | 58.3 | 25.0 |
| B | - | 66.7 | 58.3 | 55.5 | 34.5 |
| C | - | 75.0 | - | 75.0 | 75.0 |
| D | - | - | - | 41.6 | 0.0 |
| E | - | - | - | 72.2 | 72.2 |
| F | - | - | - | 72.2 | 72.2 |

404 406 402

(1) FOR BILLET OF DIMENSIONS SCALED TO RATIO 1x1x6

*FIG. 6*

QUALITATIVE COMPARISON OF RECRYSTALLIZED MICROSTRUCTURES RESULTING FROM DIFFERENT ECAE PROCESSING ROUTES

| MATERIAL | UNIFORMITY OF RECRYSTALLIZED MICROSTRUCTURE | LEVEL OF TEXTURE AS-WORKED |
|---|---|---|
| INITIAL CONDITION | NON-UNIFORM | ZERO(UNWORKED) |
| | | |
| ONE ECAE PASS | | |
| ROUTE A | NON-UNIFORM | MEDIUM |
| | | |
| TWO ECAE PASSES | | |
| ROUTE A | NON-UNIFORM | MEDIUM |
| ROUTE B | NON-UNIFORM | MEDIUM |
| ROUTE C | NON-UNIFORM | LOW |
| | | |
| FOUR ECAE PASSES | | |
| ROUTE A | NON-UNIFORM | MEDIUM |
| ROUTE B | NON-UNIFORM | MEDIUM |
| ROUTE C | UNIFORM | LOW |
| ROUTE D | UNIFORM | LOW |
| ROUTE E | UNIFORM | LOW |
| ROUTE F | UNIFORM | LOW |

600

602 604

*FIG. 5*

500

RECRYSTALLIZED GRAIN SIZE (μm) IN ECAE PROCESSED Cu, Ta, AND $Bi_2Te_3$ 512 502

| MATERIAL AND ROUTE | NUMBER OF PASSES 0 | 1 | 2 | 4 | |
|---|---|---|---|---|---|
| VAR Ta | | | | | |
| ROUTE A (1) | 5K-50K (2) | 10-250 | ( ) | ( ) | |
| C | 5K-50K | - | 45 | 34 | 504a |
| E | 5K-50K | - | - | 11 | 504a |
| | | | | | |
| ROUTE A | 500-2K | 10-200 | ( ) | ( ) | |
| C | 500-2K | - | 21 | 14 | 504b |
| E | 500-2K | - | - | 13 | 504b |
| | | | | | |
| ROUTE A | 20-100 | 45 | ( ) | ( ) | |
| C | 20-100 | - | 18 | 13 | 504c |
| E | 20-100 | - | - | 12 | 504c |
| | | | | | |
| CDA 101 Cu | (RECRYSTALLIZATION INTERVAL) | | | | |
| ROUTE A | | - | - | 150-225°C | 506 |
| B | | - | - | 100-175°C | 506 |
| C | | - | 175-250 | 150-175°C | 506 |
| E | | - | - | 100-175°C | 506 |
| | | | | | |
| p - $Bi_2Te_3$ (3) | | | | | |
| ROUTE A | 100-3K | 20-300 | ( ) | ( ) | |
| B | 100-3K | - | 15-150 | ( ) | |
| C | 100-3K | - | 10-100 | 15-40 | 508 |
| E | 100-3K | - | - | 15-35 | 508 |
| | | | | | |
| n - $Bi_2Te_3$ (4) | | | | | |
| ROUTE A | 100-3K | 10-140 | ( ) | ( ) | |
| C | 100-3K | - | 10-70 | ( ) | |
| E | 100-3K | - | - | 10-40 | 510 |

(1) ECAE PROCESSED VACUUM ARC RE-MELTED (VAR) TANTALUM AT 23°C (2) 50K MEANS 50,000

(3) p-TYPE $Bi_2Te_3$ ALLOY, PROCESSED AT 500°C (4) n-TYPE $Bi_2Te_3$ ALLOY, PROCESSED AT 450°C

EQUAL CHANNEL ANGULAR EXTRUSION METHOD

RELATED APPLICATIONS

This application claims the benefit of Ser. No. 60/343,522, entitled "System and Method to Produce Uniform Recrystallized Microstructure," filed provisionally on Dec. 20, 2001.

TECHNICAL FIELD OF THE INVENTION

The present invention relates generally to materials processing and, more particularly, to an equal channel angular extrusion method.

BACKGROUND OF THE INVENTION $Bi_2Te_3$ (Bismuth-Telluride) alloys are perhaps the best known semiconductor compounds for thermoelectric refrigeration at room temperatures. The crystal structure of $Bi_2Te_3$ and its alloys shows anisotropy in both thermoelectric and mechanical properties that are originated from the crystal structure. Hence, $Bi_2Te_3$ and its alloys can be easily cleaved in planes perpendicular to the crystallographic c-direction. The sequence of planes in the unit cell is Te1-Bi-Te2-Bi-Te1- and the adjacent tellurium atoms of successive units are bonded only by weak van der Waal's forces. Thus, extreme care is required for the fabrication and applications of these materials without material fracture during handling.

The mechanical properties of single crystalline $Bi_2Te_3$ alloys are not appropriate for its fabrication and applications. Therefore, the microstructure of poly-crystal $Bi_2Te_3$ alloys is important in determining the thermoelectric and mechanical properties of the materials. The microstructure of poly-crystal $Bi_2Te_3$ alloys, and other materials, may be improved by traditional forming processes, such as rolling, drawing, forging, and extrusion. These processes typically plastically deform the material to improve their properties by reducing the recrystallized grain size and homogenizing the microstructure. However, these processes often produce non-uniform strain, non-uniform recrystallized microstructures and unwanted or non-uniform texture, which are undesirable for some applications, such as certain thermoelectric applications.

SUMMARY OF THE INVENTION

According to one embodiment of the present invention, an equal channel angular extrusion (ECAE) method includes extruding a billet of material along a first axis in a first orientation through an ECAE die, extruding the billet along the first axis in a second orientation through the ECAE die, the second orientation oriented approximately 180° from the first direction, extruding the billet along the first axis in a third orientation through the ECAE die, the third orientation oriented approximately 90° from the second orientation, and extruding the billet along the first axis in a fourth orientation through the ECAE die, the fourth orientation oriented approximately 180° from the third orientation.

According to another embodiment of the present invention, an equal channel angular extrusion (ECAE) method includes extruding a billet of material along a first axis in a first orientation through an ECAE die, extruding the billet along the first axis in a second orientation through the ECAE die, the second orientation oriented approximately 90° from the first orientation, extruding the billet along the first axis in a third orientation through the ECAE die, the third orientation oriented approximately 180° from the second orientation, and extruding the billet along the first axis in a fourth orientation through the ECAE die, the fourth orientation oriented approximately 90° from the third orientation.

Embodiments of the invention provide a number of technical advantages. Embodiments of the invention may include all, some, or none of these advantages. Generally, a method is provided for obtaining an extruded material that has a fine grain size, uniform grain morphology and a substantial amount of high angle grain boundary misorientations for improving, among other things, thermoelectric and mechanical properties. The method effectively plastically deforms all regions of the microstructure such that it is very difficult, if not impossible, for localized microstructural regions to escape plastic deformation during working. This minimizes the amount of unworked or poorly worked material in the interior of the billet caused by advantageous local grain or multigrain region orientations. Furthermore, the volume of non-fully processed material at the ends of the billet are minimized, which results in higher production yields.

In one embodiment, the new method is more efficient in terms of reducing the number of operational steps necessary to refine microstructures than alternative methods. The refinement of the microstructure is achieved with fewer steps giving commensurate savings in the expenditure of energy and time. The reduction in labor results in higher throughput and therefore lower costs. The new method may also be utilized with many different types of materials, at many different temperatures, with many workable die or tool angles, with many different billet cross-sectional geometries, and is especially appropriate for crystalline materials.

Other technical advantages of the present invention will be readily apparent to one skilled in the art from the following figures, descriptions, and claims.

BRIEF DESCRIPTION OF THE DRAWINGS

For a more complete understanding of the invention, and for further features and advantages, reference is now made to the following description, taken in conjunction with the accompanying drawings, in which:

FIG. 4 is a table illustrating material yield for different routes of multiple pass ECAE processing in accordance with an embodiment of the present invention;

FIG. 5 is a table illustrating recrystallized grain sizes ($\mu$m) and recrystallization temperature intervals in ECAE processed $Bi_2Te_3$, tantalum, and copper in accordance with various embodiments of the present invention; and FIG. 6 is a table illustrating qualitative comparisons of recrystallized microstructures resulting from different ECAE processing routes.

DETAILED DESCRIPTION OF THE INVENTION

Example embodiments of the present invention and their advantages are best understood by referring now to FIGS. 1–6 of the drawings, in which like numerals refer to like parts.

Figure 1:
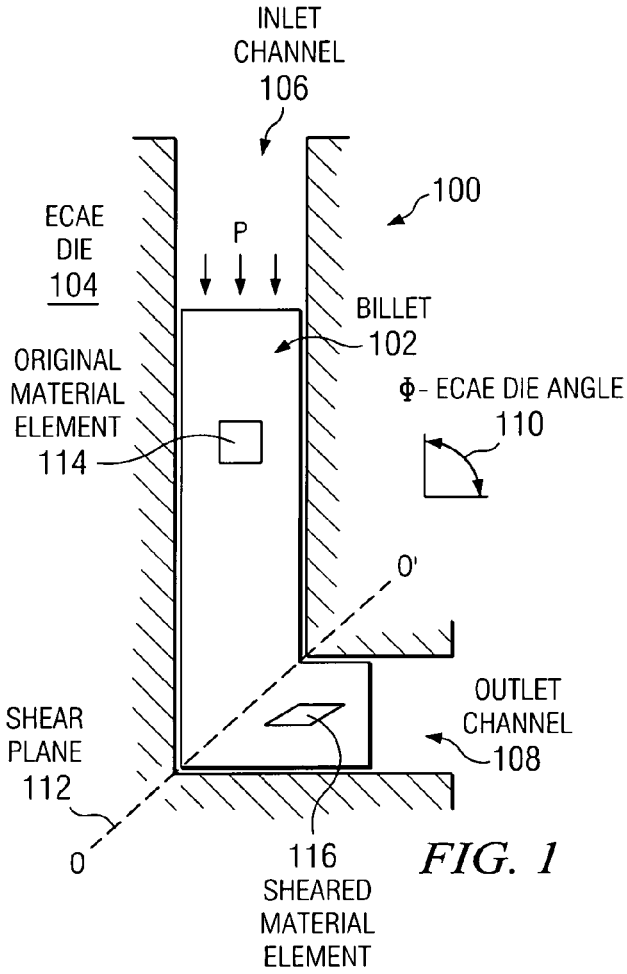
FIG. 1 is a schematic of an equal channel angular extrusion (ECAE) process showing a partially extruded billet in accordance with an embodiment of the present invention.

FIG. 1 is a schematic of an equal channel angular extrusion (ECAE) process 100 showing a partially extruded billet of material 102 in accordance with one embodiment of the present invention. ECAE process 100, which is illustrative of a conventional ECAE process, is utilized within the teachings of the present invention, as described below in conjunction with FIGS. 3A–3D, to produce a uniform microstructure within billet 102 that has a uniformly worked microstructure within the fully worked central region of the billet, a fine as-worked or recrystallized fine grain size, equi-axed grains, and minimal as-worked texture. Obtaining superior grain refinement improves, among other things, the thermoelectric and mechanical properties, as well as the mechanical properties desired for subsequent mechanical processing steps, of billet 102. In addition, ECAE process 100 is utilized within the teachings of the present invention, as described below in conjunction with FIGS. 3A–3D, to effectively plastically deform all regions of the microstructure of billet 102 such that it is very difficult for localized microstructural regions to escape plastic deformation during the extrusion process. This greatly improves microstructural homogeneity and material yield.

Billet 102 may be any suitable size having any suitable shape and may be formed from any suitable material. For purposes of clarity and consistency, billet 102 is described herein as being formed from bismuth-telluride ($Bi_2Te_3$), which is used extensively in thermoelectric applications. One reason why $Bi_2Te_3$ is used in this detailed description is that the method as outlined below in conjunction with FIGS. 3A–3D has been successfully tested by using $Bi_2Te_3$ for billet 102. Other materials, including tantalum and copper have also been successfully tested with the method outlined below; thus, the present invention does not seek to limit the material type for billet 102. Material types for which the present invention is particularly advantageous are materials which solidify with a large grain size and may be highly textured or have non-uniform texture, such as superalloys, refractory metals and alloys, and pure metals.

ECAE process 100 includes an ECAE die 104 having an inlet channel 106 and an outlet channel 108, the axes of which create an ECAE die angle 110. ECAE die 104 may be any suitable size and shape and may be formed from any suitable material. Inlet channel 106 and outlet channel 108 have nominally the same dimensions and area, which is typical in the conventional ECAE process (hence the name "equal channel"). ECAE die angle 110, in the illustrated embodiment, is approximately 90°; however, other suitable angles may be utilized.

Having inlet channel 106 and outlet channel 108 at ECAE die angle 110 creates a shear plane 112 at the transition from inlet channel 106 to outlet channel 108 that functions to plastically deform the material of billet 102 as it passes through shear plane 112. To briefly illustrate the simple shear that billet 102 is subjected to, one face of an original volumetric material element 114 of billet 102 is illustrated within inlet channel 106 to be generally square. Material element 114 represents one face of a volume element that passes through the billet to the opposite side of the billet. For clarity, material element 114 may be thought of as a single grain of billet 102. After passing through shear plane 112, material element 114 is sheared into a sheared material element 116. In essence, the grains of billet 102 elongate as a result of a single pass through shear plane 112.

In order for billet 102 to be extruded through inlet channel 106 and outlet channel 108, a pressure 118 is applied to the top of billet 102. This pressure 118 may be applied by any suitable method, such as a punch, hydrostatic pressure, or other suitable method. The amount of pressure 118 applied is dependent upon billet material and processing parameters. Once billet 102 exits outlet channel 108 this is referred to in the conventional ECAE process as one "pass." In one embodiment, for each pass, a strain of approximately 1.16 is obtained. As described in further detail below in conjunction with FIGS. 2A through 2E, multiple passes may be performed utilizing ECAE process 100.

The microstructure of billet 102 may be controlled via many process parameters, such as extrusion temperature, extrusion speed, ECAE die angle 110, and other suitable parameters. In one embodiment, an extrusion temperature at or near the recrystallization temperature ($T_R$) of the material of billet 102 is utilized. In this manner, dynamic recrystallization may be achieved during each pass. In other embodiments, the extrusion temperature is either substantially below, or substantially above, the recrystallization temperature of the material of billet 102. With respect to extrusion speed, any suitable extrusion speed may be utilized because extrusion speed is dependent upon temperature and material properties. For example, in an embodiment where $Bi_2Te_3$ is utilized, an extrusion speed within a range of approximately 0.01 to 1.0 inches per minute is utilized.

Figure 2A:
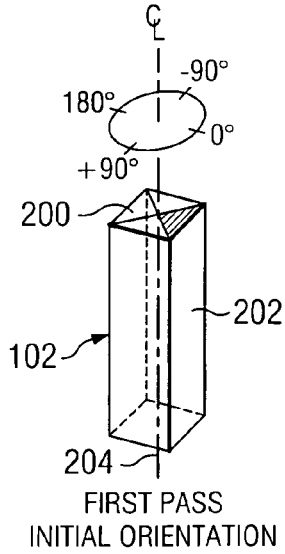
FIGS. 2A through 2E illustrate billet orientations during multiple pass ECAE processing: a) starting billet orientation, b) first extrusion completed, c) orientation for second and subsequent extrusions via Route A, d) orientation for second extrusion via route B and e) orientation for second extrusion via Route C.
Figure 2B:
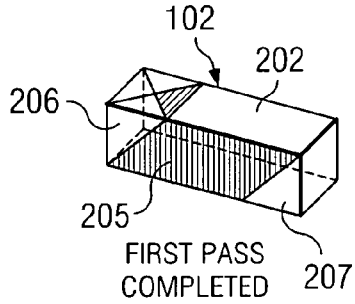
Figure 2C:
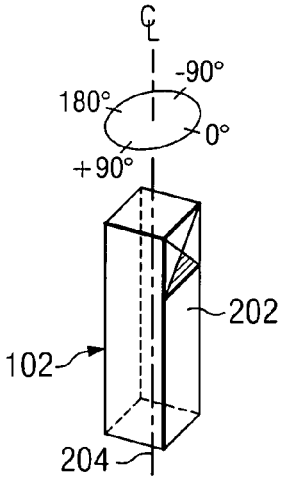
Figure 2D:
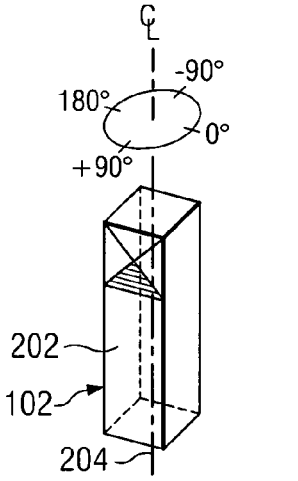
Figure 2E:
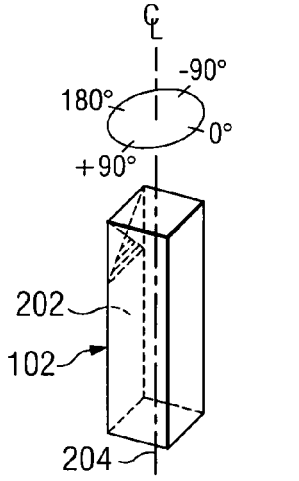

FIGS. 2A through 2E illustrate an orientation for billet 102 at the start of the first pass and subsequent second pass for multiple pass ECAE processing. FIG. 2A illustrates billet 102 in its starting orientation about its long axis 204 prior to being extruded through ECAE die 104 (FIG. 1) and FIG. 2B illustrates billet 102 after being extruded through ECAE die 104, thereby completing its first pass. As illustrated in FIG. 2A, a shaded area 200 represents the top of billet 102 during the first pass. Shaded area 200 moves from the top of billet 102 to a side 202 of billet 102, as illustrated in FIG. 2B, at the completion of the first pass. Also shown in FIG. 2B is a cross-hatched area 205. Behind cross-hatched area 205 is fully strained ECAE processed material. Note the triangular unprocessed volumetric regions 206 and 207 at each end of billet 102. For subsequent passes, conventional ECAE processing recognizes four separate "Routes," three of which are illustrated in FIGS. 2C through 2E.

FIG. 2C illustrates "Route A" processing. In Route A processing, billet 102 is inserted into inlet channel 106 with the same orientation that was used during the initial pass. Hence, with reference to FIG. 2A, side 202 of billet 102 faces the same zero degree orientation as was used during the first pass. In other words, for Route A processing, billet 102 is not rotated about long axis 204 for subsequent passes. The designation given to material processed via Route A is nA, where "n" refers to the number of passes experienced by billet 102. For Route A processing, the texture obtained for the material for billet 102 is similar to a texture obtained from a conventional rolling process.

FIG. 2D illustrates "Route B" processing. In Route B processing, billet 102 is rotated either plus 90° or minus 90° about long axis 204 from its starting position before being inserted into inlet channel 106 for a second extrusion. In the illustrated embodiment, billet 102 has been rotated plus 90°. For a third pass for Route B, billet 102 is rotated minus 90° about long axis 204 before extrusion. The texture obtained for the material for billet 102 in Route B processing is similar to a texture obtained from a conventional drawing process.

FIG. 2E illustrates "Route C" processing. In Route C processing, billet 102 is rotated 180° from its starting position before being inserted into inlet channel 106 for a second extrusion. For Route C processing, the texture obtained is minimized as compared to the texture obtained as a result of either Route A, Route B, or a combination of these two routes.

Another Route that is conventional to ECAE processing is "Route D." Although not illustrated, Route D (sometimes referred to as Route C') involves rotating billet 102 either plus 90° for four consecutive passes or minus 90° for four consecutive passes.

Routes A through D, as described above in conjunction with FIGS. 2A through 2E, utilizing multiple passes, have not been adequate to obtain the best combination of grain refinement, microstructural uniformity, and material yield, especially for materials such as $Bi_2Te_3$ and tantalum (either VAR or EB cast). Thus, the present invention seeks to address this problem, and others, by introducing an equal channel angular extrusion method, as outlined below in conjunction with FIGS. 3A through 3D.

FIGS. 3A through 3D illustrate an equal channel angular extrusion method according to the teachings of one embodiment of the present invention. For simplicity purposes, this method is referred to herein as "Route E." Route E processing includes a minimum of four passes, each of which is respectively shown in FIGS. 3A through 3D. Throughout the description of these FIGURES, a circular material element 300 and a square material element 302 that are associated with billet 102 are used to illustrate both the orientation of billet 102 during each pass and the shear strain that each of the elements 300 and 302 realize during each pass. To further aid in understanding the position and/or orientation of billet 102 during each pass, billet 102 has an area 304 marked with an "X." The method outlined in FIGS. 3A through 3D is also described with reference to FIG. 1 in which ECAE die 104 is assumed to be used for the Route E processing.

Figure 3A:
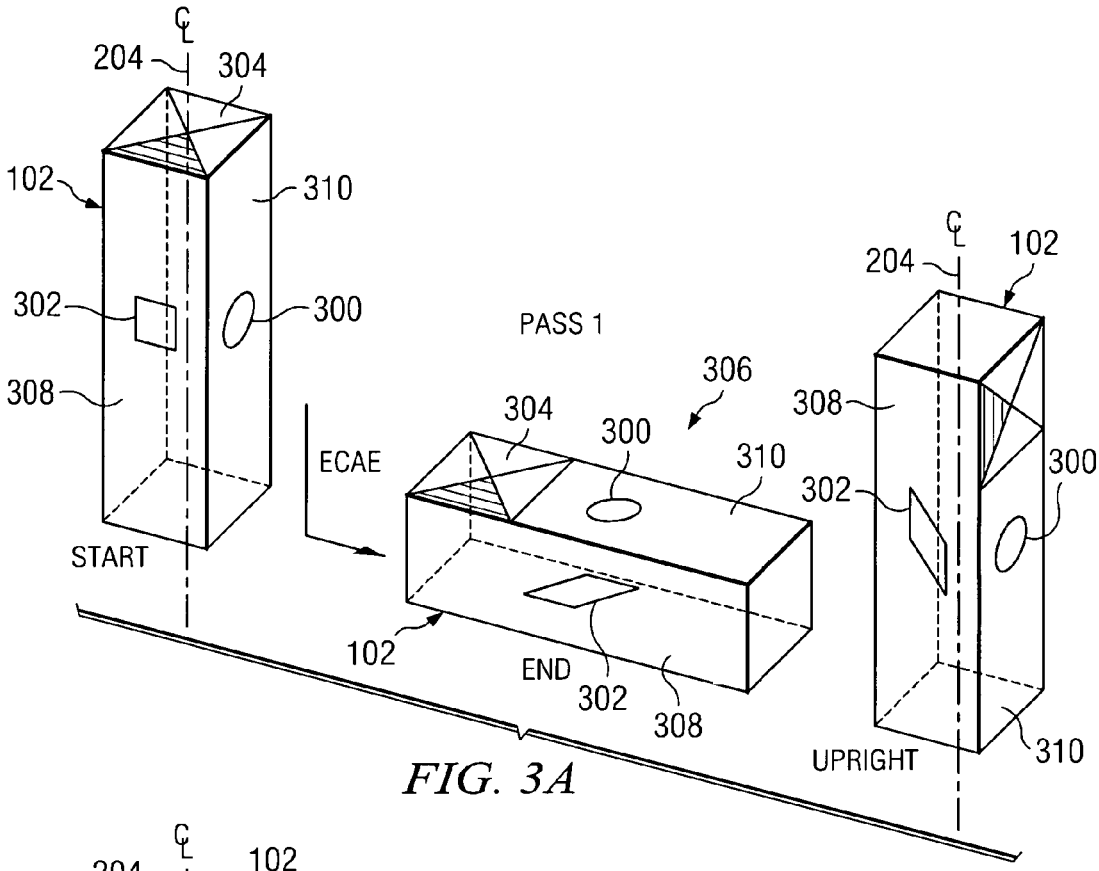
FIGS. 3A–3D illustrate an ECAE method according to one embodiment of the present invention.

FIG. 3A illustrates the first pass of Route E processing. Accordingly, billet 102 is inserted in inlet channel 106 in a particular orientation and exits outlet channel 108 in a position 306. In position 306, a side 308 of billet 102 shows square material element 302 after undergoing a shear strain, as illustrated by the elongation of square material element 302. A side 310 of billet 102 shows circular material element 300 essentially unchanged. Billet 102 is then raised on its end to prepare for the second pass.

Figure 3B:
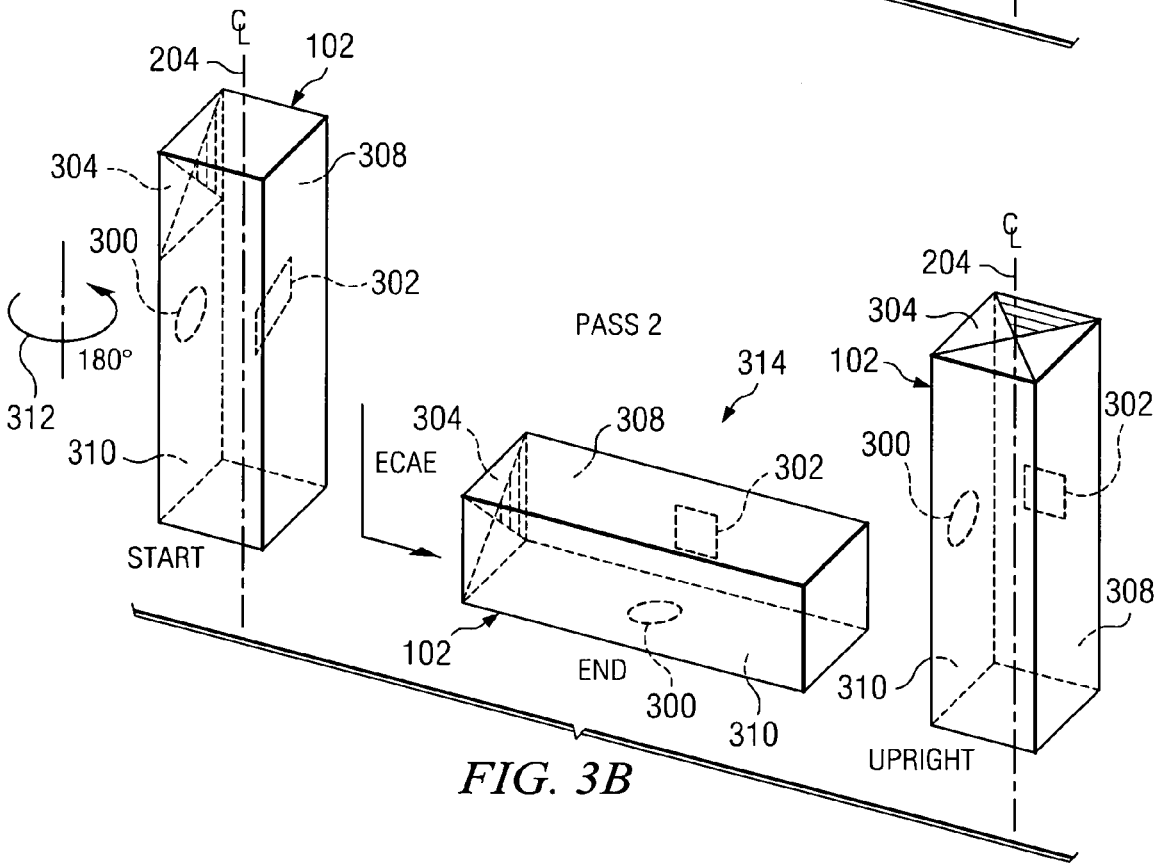

FIG. 3B illustrates the second pass for Route E processing. Accordingly, billet 102 is rotated 180° about long axis 204, as indicated by reference numeral 312 before being inserted into inlet channel 106. Billet 102 exits outlet channel 108 in a position 314. As illustrated by position 314, side 308 shows that square material element 302 is returned to its original shape. In addition, side 310 shows that circular material element 300 is still unchanged. Billet 102 is then raised on its end to prepare for the third pass.

Figure 3C:
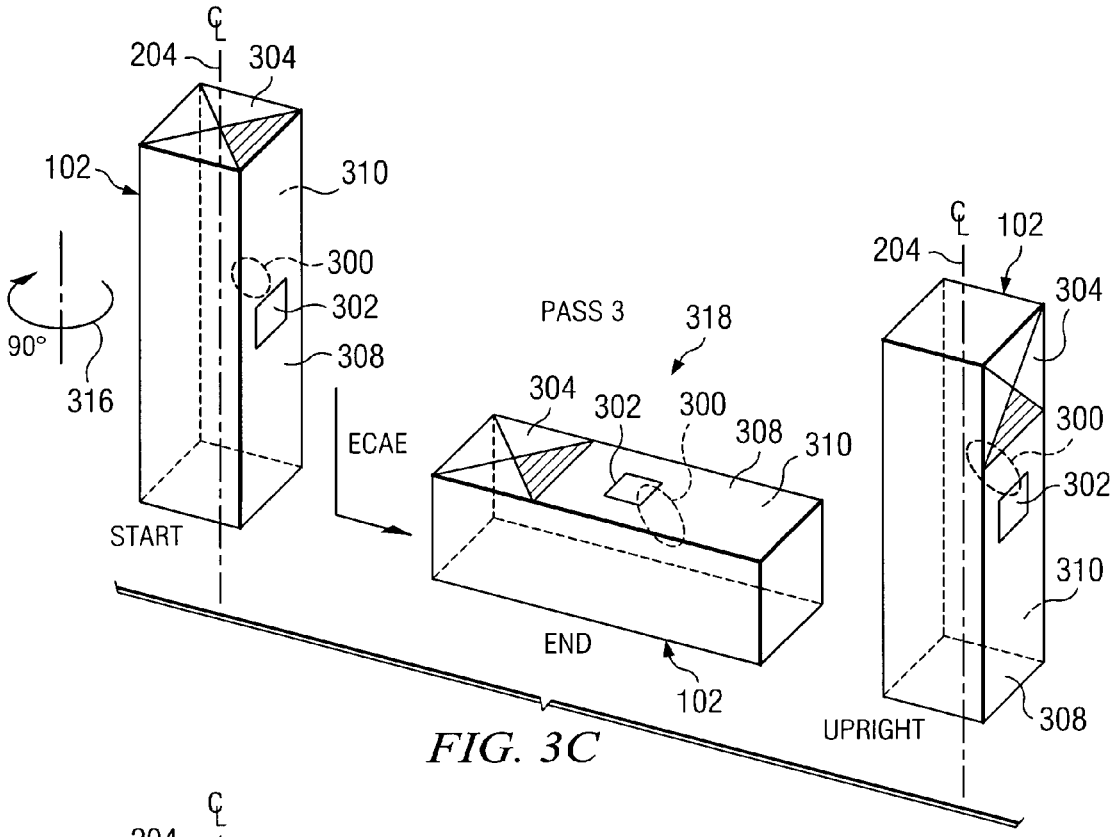

FIG. 3C illustrates the third pass for Route E processing. Accordingly, billet 102 is rotated either positive or negative 90° about long axis 204, as indicated by reference numeral 316. Billet 102 is then inserted into inlet channel 106 and exits outlet channel 108 in a position 318. As illustrated by position 318, side 310 shows circular material element 300 after undergoing a shear strain, as illustrated by the elongation of circular material element 300. A side 308 of billet 102 shows square material element 302 essentially unchanged. Billet 102 is then raised on its end to get ready for the fourth pass.

Figure 3D:
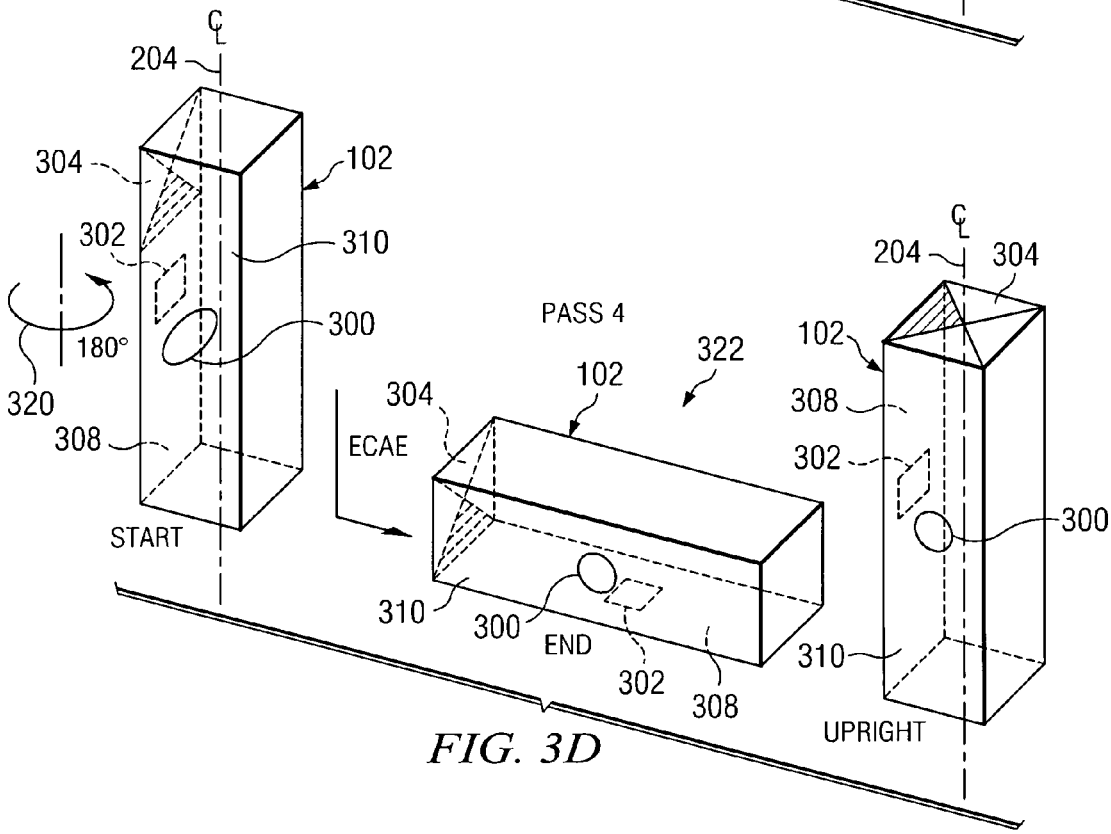

FIG. 3D illustrates the fourth, and final pass of one complete cycle of Route E processing. Accordingly, billet 102 is rotated 180° about long axis 204, as indicated by reference numeral 320 before being inserted into inlet channel 106. Billet 102 exits outlet channel 108 in a position 322. As illustrated by position 322, side 310 shows that circular material element 300 is returned to its original shape. In addition, side 308 shows that square material element 302 is still unchanged. This effectively ends one full cycle of Route E processing according to the teachings of one embodiment of the present invention. In a particular embodiment, Route E processing is repeated twice, which means that a total of eight passes are performed.

According to the teachings of another embodiment of the present invention, an ECAE process is now described. For simplicity purposes, this method is referred to herein as "Route F." Route F differs from Route E as described above only in that the billet orientations prior to each pass are different by reordering. More specifically, in Route F processing, before the second pass billet 102 is rotated either positive or negative 90°. Then, before the third pass, billet 102 is rotated 180°. And finally, before the fourth pass billet 102 is rotated negative or positive 900, respectively, depending on the rotation that was performed before the second pass. In other words, if billet 102 was rotated negative 90° before the second pass, then billet 102 is rotated positive 90° before the fourth pass. Conversely, if billet 102 is rotated positive 900 before the second pass, then billet 102 is rotated negative 90° before the fourth pass. This ensures that circular material element 300 and square material element 302 experience similar shear strains during both Route E and Route F processing.

The methods described above and illustrated by FIGS. 3A through 3D (i.e., Route E and Route F processing) facilitate the orientation of shear strains to be at intersecting directions, as illustrated by the change in shapes of both circular material element 300 and square material element 302 during the four passes. Both Route E and Route F processing obtain a favorable combination of worked microstructural uniformity, grain refinement, texture, and material yield compared to Routes A through D. These advantages are generally described below in conjunction with FIGS. 4 through 6.

FIG. 4 is a table 400 illustrating the theoretical or ideal material yield for different Routes of multiple pass ECAE processing assuming sharp boundaries between the worked and unworked end regions of billet 102 in accordance with an embodiment of the present invention. During actual ECAE processing, the boundary between the worked and unworked billet end regions may be spread to a nominal thickness of from 0.05 to 0.3 times the billet thickness. FIG. 4 is based on the ratio of billet dimensions of 1 by 1 by 6. For shorter or longer billets, the fractions of fully worked material as shown in FIG. 4 will decrease or increase, respectively. As illustrated by a column 402 of table 400, both Route E and Route F processing have substantially better material yields than four-pass Routes A, B, and D, and similar material yields to a four-pass Route C. The benefit of Route E and Route F over a four-pass Route C is that Routes E and F result in a more uniformly refined microstructure and refined grain size for the material for billet 102, as illustrated below in conjunction with FIG. 5. In addition, the one and two-pass Route A are shown in columns 404 and 406 to have better material yields than either Route E or Route F. However, the benefits of Routes E and F over either a one or two pass Route A process are that Routes E and F result in a more uniform microstructure as illustrated in FIG. 5, a more refined grain size, as illustrated in FIG. 5, and a more minimized texture, as illustrated in FIG. 6 below.

Referring to FIG. 5, a table 500 illustrates recrystallized grain sizes in ECAE processing of various materials in accordance with an embodiment of the present invention. Referring to a column 502, the benefits of Route E with respect to grain size are illustrated. For vacuum arc re-melted (VAR) Tantalum, Route E is shown in column 502 to have a smaller grain size than a four-pass Route C process. Reference numeral 504*a* illustrates the average grain size for both four-pass Route C and Route E when starting with billet 102 having an as-cast grain size, reference numeral 504*b* illustrates the average grain-size for both four-pass Route C and Route E when starting with billet 102 having a large grain-size, and reference numeral 504*c* illustrates the average grain size for both four-pass Route C and Route E when starting with billet 102 having a medium grain-size. Note a column 512, which designates starting grain-sizes for purposes of the data in FIG. 5.

For CDA 101 Copper, column 502, reference numeral 506 indicates a lower recrystallization temperature interval associated with Route E as compared to four-pass Route A and four-pass Route C, and a similar recrystallization temperature interval as compared to a four-pass Route B. The lower recrystallization temperature interval indicates that smaller grains are likely to be produced.

For a p-type $Bi_2Te_3$ alloy, column 502, reference numeral 508 indicates a smaller grain-size and a smaller range of grain-size for Route E compared to a four-pass Route C. And for n-type $Bi_2Te_3$ alloy, column 502, reference numeral 510 indicates that a small grain-size and small grain-size range are obtained with Route E.

Referring to FIG. 6, a table 600 illustrates a qualitative comparison of recrystallized microstructure resulting from different ECAE processing Routes. A column 602 illustrates that both Routes E and F have a uniform recrystallized microstructure after four passes, which is better than all Routes except for a four-pass Route C and a four-pass Route D. In addition, a column 604 illustrates that both Routes E and F have a low level of as-worked texture, which is better than all Routes except for a two or four-pass Route C and a four-pass Route D. However, the benefits of Routes E and F over Routes C and D have been illustrated above in conjunction with FIGS. 4 and 5.

As described above and generally illustrated by FIGS. 4 through 6, both Route E and Route F processing obtain a favorable combination of grain refinement, microstructural uniformity, texture, and material yield compared to Routes A through D. This facilitates the improvement of, among other things, thermoelectric and mechanical properties of $Bi_2Te_3$, its alloys, and other suitable materials. In addition, Routes E and F effectively plastically deform all regions of the microstructure such that it is very difficult, if not impossible, for localized microstructural regions to escape plastic deformation during working. This minimizes the amount of inefficiently worked material in the central portion of the billet as well as at the ends of a workpiece, which results in higher production yields, thereby leading to cost savings.

Embodiments of the present invention and some of their advantages have been demonstrated on pure copper, pure tantalum and $Bi_2Te_3$ alloys, as evidenced by data presented in FIGS. 4 through 6. These materials are representative of face centered cubic (fcc) crystal structured (Cu), body centered cubic (bcc) crystal structured (Ta), and complex crystal structured (Bi2Te3) materials. Thus, Routes E and F are widely applicable for all crystalline materials. They are especially advantageous for cast pure metals, alloys and intermetallic compound materials with large grains and highly textured and/or non-uniformly textured microstructures. The methods described herein should be economically attractive for microstructural improvements to these classes of materials: pure metals (such as copper) and alloys (such as stainless steel), refractory metals (such as Nb, Mo, Ta and W) and alloys, superalloys (such as inconel 718) and intermetallic compounds (such as $Bi_2Te_3$ and TiAl).

Although embodiments of the invention and some of their advantages are described in detail, a person skilled in the art could make various alterations, additions, and omissions without departing from the spirit and scope of the present invention as defined by the appended claims.

What is claimed is:

1. An equal channel angular extrusion (ECAE) method, comprising:

extruding a billet of material along a first axis in a first orientation through an ECAE die;

after extruding the billet in the first orientation, extruding the billet along the first axis in a second orientation through the ECAE die, the second orientation oriented approximately 180° from the first orientation;

after extruding the billet in the second orientation, extruding the billet along the first axis in a third orientation through the ECAE die, the third orientation oriented approximately 90° from the second orientation; and after extruding the billet in the third orientation, extruding the billet along the first axis in a fourth orientation through the ECAE die, the fourth orientation oriented approximately 180° from the third orientation.

2. The method of claim 1, further comprising repeating each of the extrusion steps in order.

3. The method of claim 1, wherein the ECAE die comprises an angle of ninety degrees.

4. The method of claim 1, further comprising performing each of the extrusion steps at a temperature at or near the recrystallization temperature of the material whereby dynamic recrystallization is achieved during each extrusion step.

5. The method of claim 1, further comprising performing each of the extrusion steps at a temperature substantially less than the recrystallization temperature of the material.

6. The method of claim 1, further comprising performing each of the extrusion steps at a temperature substantially greater than the recrystallization temperature of the material.

7. The method of claim 1, wherein the material is Bismuth-Telluride and further comprising performing each of the extrusion steps at an extrusion speed within a range of approximately 0.01 to 1.0 inches per minute.

8. The method of claim 1, wherein the material is selected from the group consisting of a superalloy, a refractory metal, a refractory metal alloy, and a pure metal.

9. An equal channel angular extrusion (ECAE) method, comprising:

extruding a billet of material along a first axis in a first orientation through an ECAE die;

after extruding the billet in the first orientation, extruding the billet along the first axis in a second orientation through the ECAE die, the second orientation oriented approximately 90° from the first orientation;

after extruding the billet in the second orientation, extruding the billet along the first axis in a third orientation through the ECAE die, the third orientation oriented approximately 180° from the second orientation; and after extruding the billet in the third orientation, extruding the billet along the first axis in a fourth orientation through the ECAE die, the fourth orientation oriented approximately 90° from the third orientation.

10. The method of claim 9, further comprising repeating each of the extrusion steps in order.

11. The method of claim 9, wherein the ECAE die comprises an angle of ninety degrees.

12. The method of claim 9, further comprising performing each of the extrusion steps at a temperature at or near the recrystallization temperature of the material whereby dynamic recrystallization is achieved during each extrusion step.

13. The method of claim 9, further comprising performing each of the extrusion steps at a temperature substantially less than the recrystallization temperature of the material.

14. The method of claim 9, further comprising performing each of the extrusion steps at a temperature substantially greater than the recrystallization temperature of the material.

15. The method of claim 9, wherein the material is Bismuth-Telluride and further comprising performing each of the extrusion steps at an extrusion speed within a range of approximately 0.01 to 1.0 inches per minute.

16. The method of claim 9, wherein the material is selected from the group consisting of a superalloy, a refractory metal, a refractory metal alloy, and a pure metal.

17. An equal channel angular extrusion (ECAE) method, comprising:

extruding a billet of material along a first axis in a first orientation through an ECAE die;

after extruding the billet in the first orientation, extruding the billet along the first axis in a second orientation through the ECAE die, the second orientation oriented approximately 180° from the first orientation;

after extruding the billet in the second orientation, extruding the billet along the first axis in a third orientation through the ECAE die, the third orientation oriented approximately 90° from the second orientation;

after extruding the billet in the third orientation, extruding the billet along the first axis in a fourth orientation through the ECAE die, the fourth orientation oriented approximately 180° from the third orientation;

after extruding the billet in the fourth orientation, extruding the billet along the first axis in a fifth orientation through the ECAE die, the fifth orientation oriented approximately 90° from the first orientation;

after extruding the billet in the fifth orientation, extruding the billet of material along the first axis in a sixth orientation through the ECAE die, the sixth orientation oriented approximately 180° from the fifth orientation;

after extruding the billet in the sixth orientation, extruding the billet along the first axis in a seventh orientation through the ECAE die, the seventh orientation oriented approximately 90° from the sixth orientation; and after extruding the billet in the seventh orientation, extruding the billet along the first axis in an eighth orientation through the ECAE die, the eighth orientation oriented approximately 180° from the seventh orientation.

18. The method of claim 17, further comprising performing each of the extrusion steps at a temperature at or near the recrystallization temperature of the material whereby dynamic recrystallization is achieved during each extrusion step.

19. The method of claim 17, further comprising performing each of the extrusion steps at a temperature substantially less than the recrystallization temperature of the material.

20. The method of claim 17, further comprising performing each of the extrusion steps at a temperature substantially greater than the recrystallization temperature of the material.

* * * * *